US009926729B2

(12) United States Patent
Debenedetti et al.

(10) Patent No.: US 9,926,729 B2
(45) Date of Patent: Mar. 27, 2018

(54) RETRACTABLE SCREEN DOOR HANDLE ASSEMBLY

(71) Applicant: J & S COMPANY LLC, Boise, ID (US)

(72) Inventors: Stephen Debenedetti, Boise, ID (US); John Seevers, McCall, ID (US)

(73) Assignee: J & S COMPANY LLC, Boise, ID (US)

( * ) Notice: Subject to any disclaimer, the term of this patent is extended or adjusted under 35 U.S.C. 154(b) by 0 days.

(21) Appl. No.: 15/400,228

(22) Filed: Jan. 6, 2017

(65) Prior Publication Data

US 2017/0191294 A1 Jul. 6, 2017

Related U.S. Application Data

(60) Provisional application No. 62/275,495, filed on Jan. 6, 2016.

(51) Int. Cl.

| | |
|---|---|
| ***E05C 19/16*** | (2006.01) |
| ***E05B 7/00*** | (2006.01) |
| ***E05B 47/00*** | (2006.01) |
| ***E05B 65/08*** | (2006.01) |
| *E05B 3/00* | (2006.01) |

(52) U.S. Cl.

CPC ..... *E05C 19/16* (2013.01); *E05B 7/00* (2013.01); *E05B 47/0038* (2013.01); *E05B 65/08* (2013.01)

(58) Field of Classification Search

CPC ..... Y10T 292/11; E05C 19/16; E05C 19/165; E05B 7/00; E05B 47/0038; E05B 65/0025; E05B 65/08; E05B 65/0832; E05B 65/0841

See application file for complete search history.

(56) References Cited

U.S. PATENT DOCUMENTS 2,514,927 A * 7/1950 Bernhard ..... E05C 19/16 292/251.5
3,288,511 A * 11/1966 Tavano ..... E05C 19/16 292/251.5

(Continued)

FOREIGN PATENT DOCUMENTS

JP 5284629 9/2013

OTHER PUBLICATIONS

Canadian Intellectual Property Office; Office Action; Canadian Patent Application No. 2,954,216; dated Dec. 28, 2017.

*Primary Examiner* — Alyson M Merlino
(74) *Attorney, Agent, or Firm* — Parsons Behle & Latimer

(57) ABSTRACT

A handle assembly includes a first handle, a second handle, and a magnet. The first handle is moveably attached to a first base. The second handle is moveably attached to a second base. The magnet magnetically couples the first handle to a striker plate. Movement of the first handle with respect to the first base uncouples the magnet and the striker plate. Movement of the second handle with respect to the second base moves the first handle with respect to the first base. A handle assembly includes a first handle and a magnet. The first handle is pivotable about a first axis. The magnet magnetically couples the handle assembly to a doorjamb. Pivotal movement of the first handle uncouples the handle assembly from the doorjamb. The handle assembly may include a second handle pivotable about a second axis. Pivotal movement of the second handle pivots the first handle.

26 Claims, 5 Drawing Sheets

(56) References Cited

U.S. PATENT DOCUMENTS

| | | | | | |
|---|---|---|---|---|---|
| 3,314,707 | A * | 4/1967 | Van Donselaar | E05C 19/16 | 292/251.5 |
| 3,350,127 | A * | 10/1967 | Hekelaar | E05C 19/16 | 292/251.5 |
| 4,711,480 | A * | 12/1987 | Horgan, Jr. | E05B 65/106 | 292/336.3 |
| 5,865,483 | A * | 2/1999 | Dubravin | E05B 7/00 | 292/251.5 |
| 5,975,662 | A * | 11/1999 | Weber | A47B 88/463 | 292/251.5 |
| 6,000,735 | A * | 12/1999 | Jourdenais | E05B 65/0841 | 292/251.5 |
| 6,253,826 | B1 * | 7/2001 | Witter | E06B 3/481 | 292/251.5 |
| 9,790,708 | B2 * | 10/2017 | Clark | E05C 19/163 | |
| 2005/0108945 | A1 * | 5/2005 | Wiemer | E05C 19/16 | 49/278 |
| 2005/0225098 | A1 * | 10/2005 | Kliefoth | E05C 19/163 | 292/251.5 |

* cited by examiner

RETRACTABLE SCREEN DOOR HANDLE ASSEMBLY

RELATED APPLICATION DATA

The present application claims the benefit of priority under 35 U.S.C. § 119 to U.S. Provisional Application No. 62/275,495, filed Jan. 6, 2016, entitled "Retractable Screen Door Handle Assembly," the disclosure of which is incorporated herein by reference in its entirety.

FIELD OF THE DISCLOSURE

The embodiments described herein relate generally to a handle assembly. In particular, the disclosure relates to a magnetic handle assembly for sliding screen doors and windows.

BACKGROUND

Description of the Related Art

Known handle assemblies use a magnet on the sliding frame of a retractable screen door to latch the door in a closed position. A striker plate is positioned on the doorjamb adjacent to the screen frame and magnetically couples the screen door to the doorjamb. Once the magnet is positioned sufficiently close to the striker plate, the magnet engages the striker plate and holds the screen door in the closed position. In order to open the screen door, the operator pushes or pulls on the frame of the screen door. The pushing or pulling motion moves the magnet laterally in relation to the striker plate and uncouples the magnet from the striker plate. Typically, the operator pushes from the inside and pulls from the outside.

Among the various disadvantages of the prior art, operators may be unfamiliar with the operation of the magnetic coupling, opening the door may be cumbersome or difficult, and lateral movement of the screen frame may stress the screen frame. Other disadvantages may exist.

SUMMARY

The present disclosure is directed to a handle assembly that addresses some of the problems and disadvantages discussed above.

One embodiment is a handle assembly comprising a first handle, a second handle, and a magnet. The first handle is moveably attached to a first base. The first base may be integral to a frame. The second handle is moveably attached to a second base. The second base may be integral to the frame. The magnet is configured to magnetically couple the first handle to a striker plate. Movement of the first handle with respect to the first base moves at least one of the magnet and the striker plate, and movement of the second handle with respect to the second base moves the first handle with respect to the first base.

The magnet may be affixed to a side of the first handle. The first handle may be pivotally attached to the first base. The first base may include a rod passage and the second base may include a rod passage. The handle assembly may include a lever and a rod. The lever may be rotatably connected to the first base, such that rotation of the lever moves the first handle. The rod may extend through the rod passage of the first base and the rod passage of the second base, such that movement of the rod rotates the lever. The first handle may include a first tang positioned adjacent to an end of the lever. The lever may be positioned within a cavity in the first base. The first base may include a floor below the cavity and the cavity may include a side opening. The second handle may be pivotally attached to the second base.

One embodiment is a handle assembly comprising a first handle and a magnet. The first handle is pivotable about a first axis. The magnet is configured to magnetically couple the handle assembly to a doorjamb. Pivotal movement of the first handle is configured to uncouple the handle assembly from the doorjamb.

The handle assembly may include a second handle pivotable about a second axis. Pivotal movement of the second handle is configured to pivot the first handle about the first axis. The first handle may include a first tang and the second handle may include a second tang. The first tang may be positioned adjacent to the second tang, such that pivotal movement of the second handle causes the second tang to contact the first tang and pivot the first handle. The first tang and the second tang may be indirectly connected. The handle assembly may include a rod and a lever. The rod has a first end and a second end. The lever has a first end and a second end. The lever may be rotatable about a third axis. The first tang may be positioned adjacent to the second end of the lever. The second tang may be positioned adjacent to the first end of the rod. The second end of the rod may be positioned adjacent to the first end of the lever.

One embodiment is of a method for operating a handle. The method comprises providing a first handle. The first handle has a side portion and a magnet affixed to the side portion. The first handle is attached to a frame. The method include magnetically coupling the magnet to a strike plate and moving the first handle with respect to the frame, which moves at least one of the magnet and the striker plate to uncouple the magnet from the striker plate.

The magnet may be moved laterally with respect to the striker plate. The handle may be pivotally attached to the frame. Moving the first handle may comprise pivoting the first handle. The method may include providing a second handle and pivoting the second handle. Pivoting the second handle may cause the first handle to pivot. Pivoting the first handle may not cause the second handle to pivot. The method may include providing a second handle, providing a rod with a first end and a second end, and providing a lever with a first end and a second end. Moving the first handle may include moving the second handle and contacting the first end of the rod with a portion of the second handle, contacting the first end of the lever with the second end of the rod, rotating the lever, and contacting a portion of the first handle with the second end of the lever as the lever rotates. The method may include sliding the first handle away from the striker plate after the magnet is moved with respect to the striker plate.

One embodiment is a handle assembling comprising a first handle, a second handle, and a magnet. The first handle is moveably attached to a first base and the first base may be affixed to a first side of a frame. The first handle includes a first tang. The second handle is moveably attached to a second base. The second base may be affixed to a second side of the frame. The second handle includes a second tang. The second tang may be positioned to engage the first tang. The magnet is affixed to a side portion of the first handle.

The handle assembly may include a striker plate affixed to a doorjamb, the magnet and striker plate being configured to be magnetically coupled. The first handle may be pivotally attached to the first base and the second handle may be pivotally attached to the second base. Movement of the first handle with respect to the first base uncouples the magnet from the striker plate. Movement of the second handle with respect to the second base may engage the second tang with the first tang and move the first handle with respect to the first base.

One embodiment is a handle assembly comprising a first handle, a second handle, and a locking mechanism. The first handle includes a grip member and a side portion. The second handle includes a grip member. The locking mechanism is configured to magnetically couple the handle assembly to a doorjamb. Movement of either one of the grip member of the first handle or the grip member of the second handle is configured to uncouple the handle assembly from the doorjamb.

The locking mechanism may include a striker plate affixed to the doorjamb and a magnet affixed to the side portion of the first handle. The magnet may engage the striker plate to magnetically couple the handle assembly to a doorjamb. The first handle and the second handle may be affixed to opposing sides of a frame.

BRIEF DESCRIPTION OF THE DRAWINGS

FIG. 5 shows the handle assembly in a locked position. FIG. 6 shows the handle assembly in an unlocked position.

Figure 1:
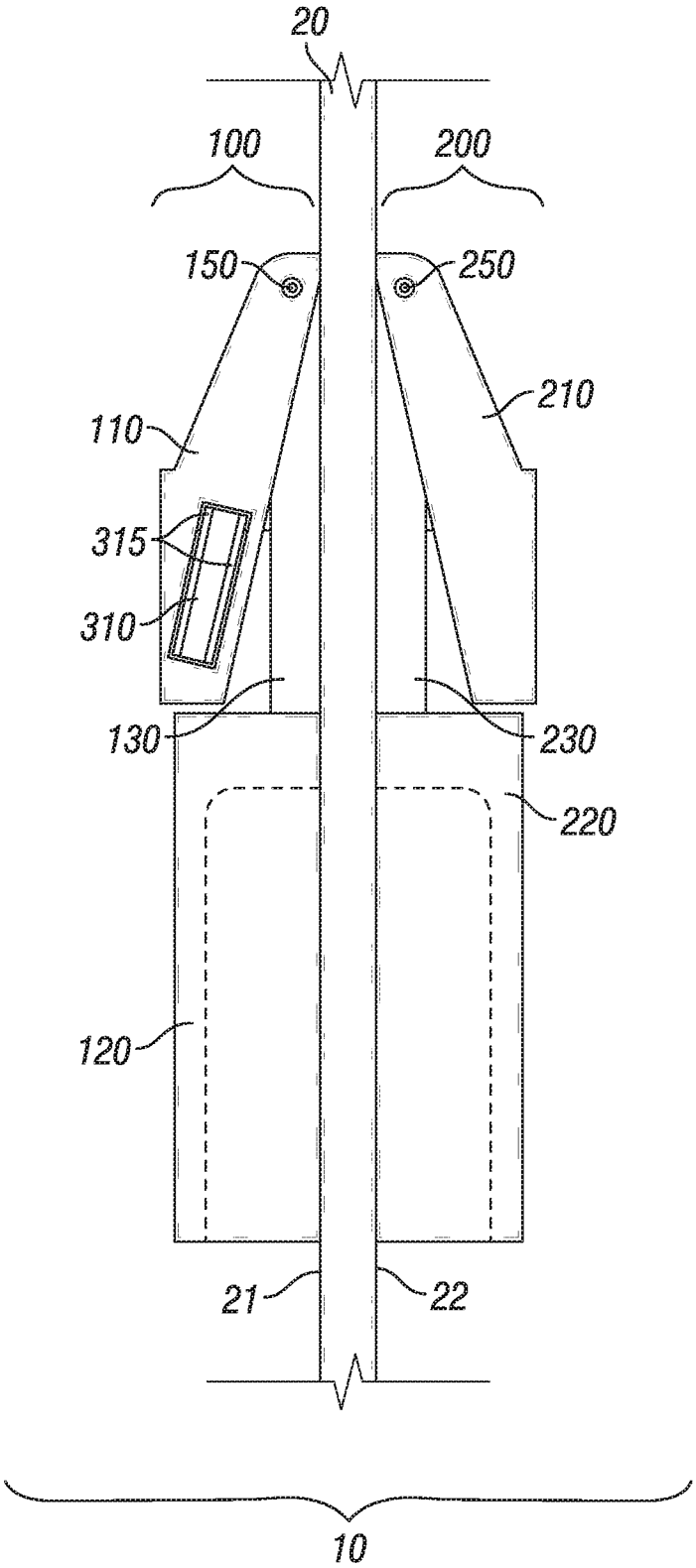
FIG. 1 shows an embodiment of a handle assembly attached to a sliding frame.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

A handle assembly includes a first handle and a second handle. A magnet assembly is housed within a side of the first handle. The first handle and second handle are each movable between a first position and a second position. The first handle may be pivotable about a first axis and the second handle may be pivotable about a second axis. When the first handle is in the first position, the magnet is positioned to magnetically couple the handle assembly, and thereby a sliding frame connected thereto, to a striker plate positioned on a doorjamb. When the first handle is in the second position, the magnet is not positioned to magnetically couple the handle assembly to a striker plate positioned on a doorjamb, thereby allowing the sliding frame connected to the handle assembly to slide without being impeded by the magnet. Movement of the second handle from its first position to its second position causes the first handle to move from its first position to its second position via a mechanical link between the first handle and the second handle. Movement of the first handle from its first position to its second position may not cause movement of the second handle. The mechanical link may include a rod and rotatable lever.

FIG. 1 show an embodiment of a handle assembly 10 having a first handle portion 100 and a second handle portion 200. As shown, handle assembly 10 is attached to a frame 20. Frame 20 may be a sliding frame, such as a retractable sliding screen door or window. The frame 20 slides between an open position and a closed position. First handle portion 100 is mounted to a first side 21 of frame 20 and second handle portion 200 is mounted to a second side 22 of frame 20. First handle portion 100 may include a grip 120 and second handle portion 200 may include a grip 220. Grip 120 and grip 220 may each provide a surface for an operator to grasp when moving frame 20 between its open and closed positions.

Handle assembly 10 also includes a magnet 310 positioned on the side of first handle portion 100. In some embodiments, magnet 310 is housed between a plurality of contact plates 315. Contact plates 315 may localize the magnetic field of magnet 310. Contact plates 315 extend further from the side of first handle portion 100 than magnet 310 to provide a surface for contacting a striker plate 320 mounted on a doorjamb 30 (shown in FIGS. 5 and 6). As used herein, the term doorjamb means any object intended to hold the frame in its closed position. In some embodiments, striker plate 320 may be mounted on a French door. Contact plates 315 may be coated with a friction reducer, such as polytetrafluoroethylene. Striker plate 320 (shown in FIGS. 5 and 6), may be coated a friction reducer, such as polytetrafluoroethylene. A magnetic force between magnet 310 and striker plate 320 couples handle assembly 10 to doorjamb 30 (shown in FIGS. 5 and 6). As frame 20 is connected to handle assembly 10, it is inhibited from moving away from doorjamb 30. A portion of frame 20 may slide behind doorjamb 30 to minimize the distance first handle portion 100 extends beyond doorjamb 30. First handle portion 100 may include a cutout (not shown) configured to allow first handle portion 100 to pivot with respect to a doorjamb 30 without interference by doorjamb 30.

In operation, frame 20 may slide towards striker plate 320 until magnet 310 magnetically engages striker plate 320 and holds frame 20 in its closed position. Magnet 310 holds frame 20 in the closed position but allows frame 20 to be opened. For example, if a person were to run into a screen attached to frame 20, the force of the impact would separate magnet 310 from striker plate 320 and allow the screen to automatically retract. Thus, damage to the screen may be avoided.

As shown in FIG. 1, magnet 310 may be housed within a side portion of first handle portion 100. However, a person of ordinary skill in the art having the benefit of this disclosure would appreciate that magnet 310 may also be housed within a side portion of second handle portion 200. First handle portion 100 and second handle portion 200 are each movable between an engaged position and a disengaged position. In the engaged position, magnet 310 and striker plate 320 magnetically couple handle assembly 10 to doorjamb 30. In the disengaged position, magnet 310 and striker plate 320 do not magnetically couple handle assembly 10 to doorjamb 30.

First handle portion 100 includes a first handle 110 and base 130. Base 130 is configured to be mounted to first side 21 of frame 20. Grip 120 and base 130 may be a single integral piece. Base 130 may be integral to frame 20. Base 130 may comprise a plastic material. First handle 110 may comprise a stiff, non-plastic material. First handle 110 may include a relief shaped to receive hands of users with long fingernails. Base 130 is configured to receive first handle 110 and allow movement of first handle 110 thereon to transition first handle portion 100 between its engaged position and disengaged position. First handle 110 may be biased with first handle portion 100 in the engaged position. During the transition of first handle portion 100 from its engaged position to its disengaged position, contact plates 315 slide along striker plate 320 (shown in FIGS. 5 and 6) until magnet 310 between contact plates 315 is no longer aligned with striker plate 320.

First handle 110 is moveably attached to base 130 of first handle portion 100. As shown in FIG. 1, first handle 110 is pivotally attached to base 130. A pin 150 may attach first handle 110 to base 130 and allow pivotal motion of first handle 110 about pin 150. Pin 150 may be oriented such that first handle 110 rotates about a horizontal axis perpendicular to doorjamb 30.

Second handle portion 200 includes a second handle 210 and base 230. Base 230 is configured to be mounted to second side 22 of frame 20. Grip 220 and base 230 may be a single integral piece. Base 230 may be integral to frame 20. Base 230 may comprise a plastic material. Second handle 210 may comprise a stiff, non-plastic material. Second handle 210 may include a relief shaped to receive hands of users with long fingernails. Base 230 is configured to receive second handle 210 and allow movement of second handle 210 thereon to transition second handle portion 200 between its engaged position and disengaged position. Second handle 210 is moveably attached to base 230. As shown in FIG. 1, second handle 210 is pivotally attached to base 230. A pin 250 may attach second handle 210 to base 230 and allow pivotal motion of second handle 210 about pin 250. Pin 250 may be oriented such that second handle portion 200 rotates about a horizontal axis perpendicular to doorjamb 30. The pin 250 may be integral to base 230 or second handle 210.

Second handle 210 is mechanically linked to first handle 110 of first handle portion 100. It its engaged position, second handle 210 of second handle portion 200 facilitates the positioning of magnet 310 on first handle portion 100 such that first handle portion 100 is in its engaged position. Through the transition of second handle portion 200 from its engaged position to its disengaged position, second handle 210 mechanically moves first handle 110 so that first handle portion 100 is in its disengaged position as well and magnet 310 is no longer positioned to magnetically couple frame 20 to striker plate 320 disposed on doorjamb 30. Second handle 210 may be biased with second handle portion 200 in the engaged position.

When first handle portion 100 is in the engaged position (shown in FIG. 5), magnet 310 is aligned with striker plate 320 and magnetically couples first handle portion 100 to striker plate 320. When first handle portion 100 is in the disengaged position (shown in FIGS. 6), magnet 310 is not aligned with strike plate 320 and frame 20 is not inhibited from moving away from doorjamb 30. In operation, an operator may move first handle 110 between the engaged position and the disengaged position by applying a force to first handle 110. Sufficient movement of first handle 110 may include a lifting, rotating, pushing, pulling, sliding, or pivoting motion. However, it is appreciated that the transition between the engaged position and the disengaged position is facilitated by movement of part of handle assembly 10, rather than movement of frame 20 itself. In other words, frame 20 may remain static while first handle 110 or second handle 210 is moved. As shown in FIG. 1, first handle 110 may be moved between its engaged and disengaged positions by pivoting first handle 110 about pin 150 or by pivoting second handle 210 about pin 250, which causes first handle 110 to pivot about pin 150.

Figure 2:
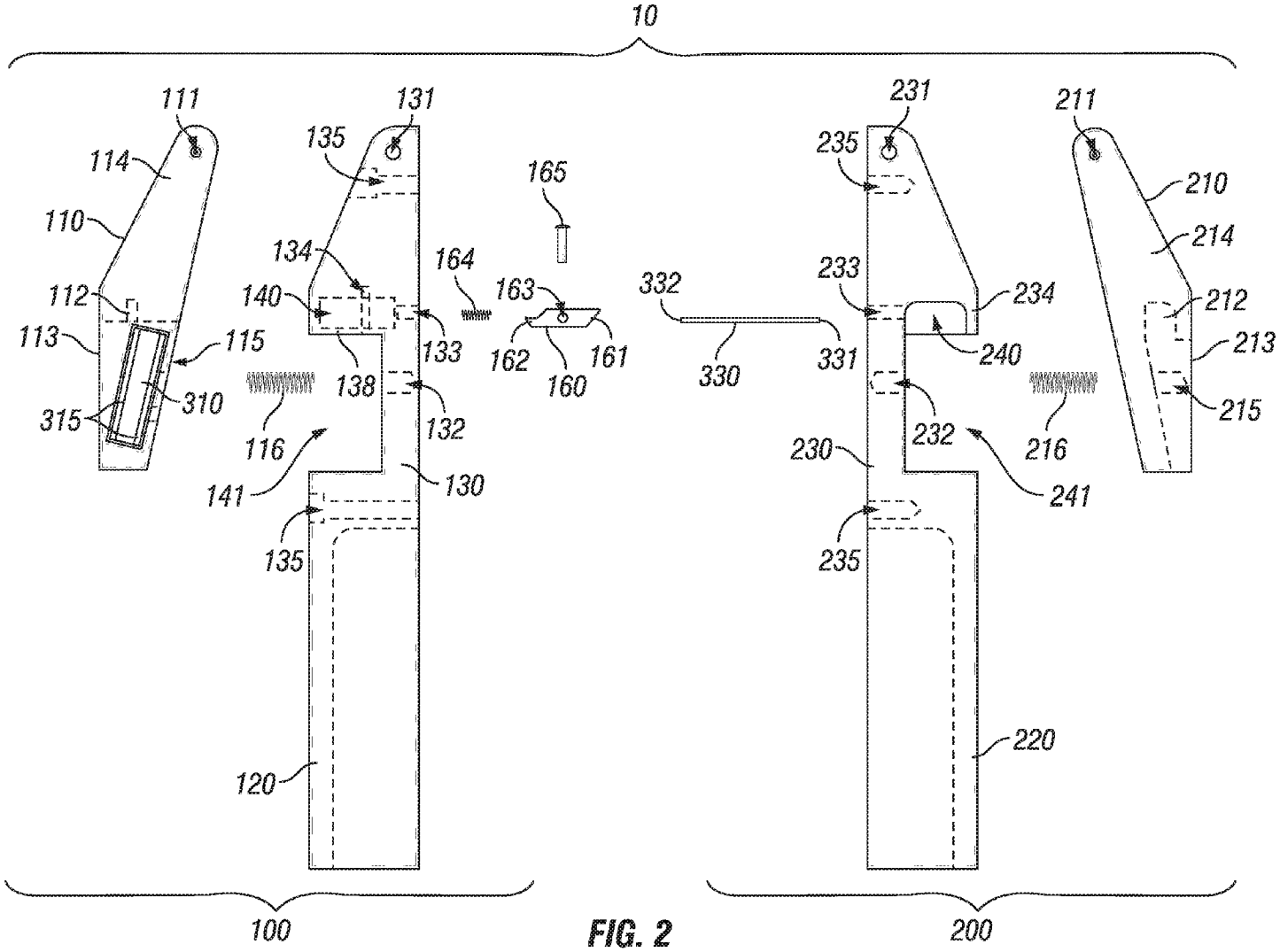
FIG. 2 shows an exploded view of the handle assembly of FIG. 1.

FIG. 2 shows an exploded view of handle assembly 10. First handle 110 includes a pivot aperture 111, a tang 112, a body 113, arms 114, and a spring cavity 115. Body 113 may provide a surface for a user to apply force when operating first handle portion 100. As shown, body 113 may be connected to two arms 114 (shown in FIG. 3) with pivot apertures 111 therein. Arms 114 may form the sides of first handle 110. Magnet 310 and contact plates 315 may be housed within one of the arms 114 and extend into the body 113 of first handle 110. Base 130 may include mounting apertures 135 to mount base 130 to frame 20 (shown in FIG. 1). Base 130 includes a pivot aperture 131, a spring cavity 132, and a rod passage 133. The pivot apertures 111 of first handle 110 are positioned to align with pivot aperture 131 of base 130. A pin 150 (shown in FIG. 1) may be received through pivot apertures 111, 131 to pivotally connect first handle 110 to base 130. Pin 150 may be integral to base 130 or first handle 110. First handle portion 100 includes a spring 116 positioned between first handle 110 and base 130. Spring 116 is retained within spring cavity 132 of base 130 and spring cavity 115 of first handle 110. Spring 116 may bias body 113 of first handle 110 away from base 130. Spring 116 may bias first handle 110 into the engaged position of first handle portion 100. Spring 116 may comprise a non-magnetic material. Base 130 also includes a recess 141 shaped to receive body 113 of first handle 110. In operation, an operator presses upon body 113 of first handle 110 and against the spring force of spring 116, which causes first handle 110 to pivot about pivot aperture 111. As first handle 110 pivots, body 113 of first handle 110 move into recess 141 of base 130 and carries magnet 310 out of alignment with striker plate 320 on doorjamb 30 (shown in FIG. 6).

Figure 4:
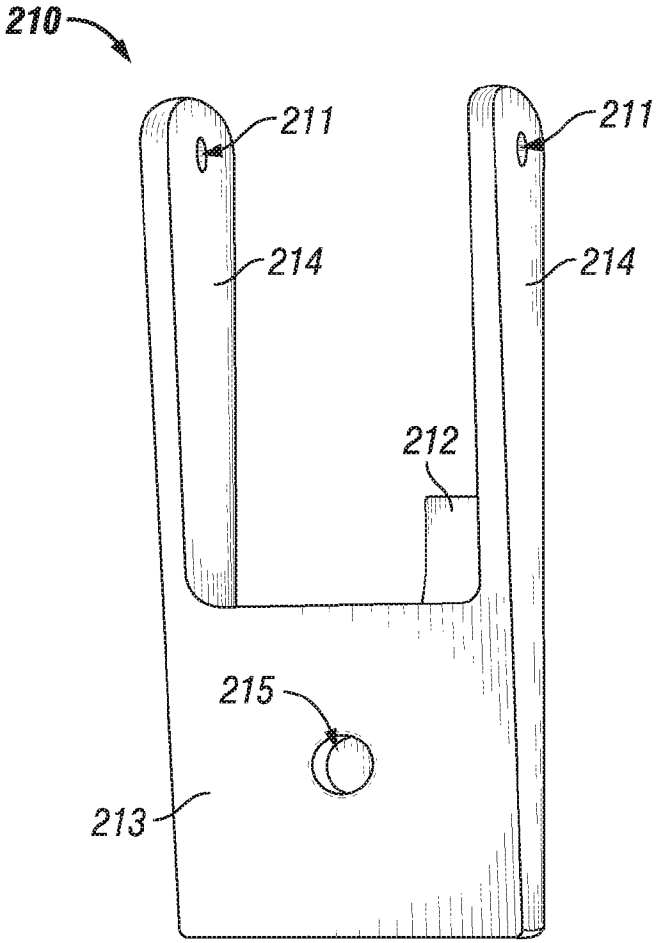
FIGS. 3 and 4 show embodiments of handles.

Second handle 210 includes a pivot aperture 211, a tang 212, a body 213, arms 214, and a spring cavity 215. Body 213 may provide a surface for a user to apply force when operating the second handle 200. As shown in FIG. 4, body 213 may be connected to two arms 214 with pivot apertures 211 therein. Arms 214 may form the sides of second handle 210. Base 230 may include mounting apertures 235 to mount base 230 to a frame 20 (shown in FIG. 1). Mounting apertures 235 of the base 230 may align with mounting apertures 135 of first handle portion 100. A bolt (not shown) may pass through mounting apertures 135 of first handle portion 100, through frame 20, and into mounting apertures 235 of second handle portion 200 to secure base 130 of first handle portion 100 to base 230 of second handle portion 200. Base 230 includes a pivot aperture 231, a spring cavity 232, and a rod passage 233. The pivot apertures 211 of the second handle 210 are positioned to align with pivot aperture 231 of base 230. A pin 250 (shown in FIG. 1) may be received through pivot apertures 211, 231 to pivotally connect second handle 210 to base 230. Pin 250 may be integral to base 230 or second handle 210. Second handle 200 includes a spring 216 positioned between second handle 210 and base 230. Spring 216 is retained within spring cavity 232 of base 230 and spring cavity 215 of second handle 210. In some embodiments, base 230 includes a lip 234 adjacent to a cavity 240. Cavity 240 is shaped to receive tang 212. Base 230 also includes a recess 241 shaped to receive body 213 of second handle 210. Recess 241 may be open to cavity 240. Tang 212 and cavity 240 may extend along the length of body 213. Spring 216 may bias body 213 of second handle 210 away from base 230 and place the outer side of tang 212 into contact with lip 234. The interface between tang 212 and lip 234 may prevent over-rotation of second handle 210 due to the spring force of spring 116. In some embodiments, a lip may be positioned in the bottom of recess 241 to contact a lower profile of second handle 210 to prevent over-rotation. In operation, an operator presses upon body 213 of second handle 210 and against the spring force of spring 216, which causes second handle 210 to pivot about pivot aperture 211. As second handle 210 pivots, body 213 of second handle 210 move into recess 241 of base 230.

The movement of second handle 210 is mechanically linked so that movement of second handle 210 also causes movement of first handle 110. FIG. 2 shows one embodiment of a mechanical link between first handle 110 and second handle 210. The mechanical link is comprised of a rod 330 and lever 160. For the purposes of illustration, lever 160 has been rotated 90 degrees to show its features. Base 130 of first handle portion 100 includes a cavity 140 shaped to receive the lever 160. Cavity 140 includes an opening 137 (shown in FIGS. 5 and 6) in the side of base 130 to receive tang 112 therethrough. Base 130 may include a floor 138 separating cavity 140 from recess 141. The lever 160 includes a first end 161 and a second end 162. Lever 160 also includes an aperture 163 shaped to receive a pin 165 to rotatably mount lever 160 within cavity 140. A pivot aperture 134 may intersect cavity 140 and receive pin 165 to create an axis of rotation for lever 160. The second end 162 of lever 160 may include a profile shaped to receive tang 112 of first handle 110. The spring force of spring 116 may bias tang 112 into contact with the second end 162 of lever 160. The interface between tang 112 and the second end 162 of lever 160 may prevent over-rotation of first handle 110 due to the spring force of spring 116. In some embodiments, a lip may be positioned in the bottom of recess 141 to contact the lower profile of first handle 110 to prevent over-rotation. A spring 164 is positioned within a slot 136 (shown in FIGS. 5 and 6) in base 130 to bias the first end 161 of lever 160 into contact with rod 330.

Rod 330 includes a first end 331 and a second end 332. Rod 330 extends through rod passage 133 of first handle portion 100, rod passage 233 of second handle portion 200, and through a passage 23 (shown in FIGS. 5 and 6) in frame 20. First end 331 of rod 330 is positioned adjacent to tang 212 of second handle 210. Second end 332 of rod 330 is positioned adjacent to the first end 161 of lever 160. The second end 162 of lever 160 is positioned adjacent to tang 112 on first handle 110 (best shown in FIGS. 5 and 6).

Although the mechanical link has been described with respect to distinct components, the mechanical link may be interconnected as would be appreciated by one of ordinary skill in the art having the benefit of this disclosure. For example, first end 331 of rod 330 may be pivotally connected to tang 212 of second handle 210. Second end 332 of rod 330 may be pivotally connected to the first end 161 of lever 160. The second end 162 of lever 160 may be pivotally connected to tang 112 of first handle 110, but might inhibit independent operation of first handle portion 100 with respect to second handle portion 200.

Second handle portion 200 may form a four-bar mechanism to operate handle assembly 10. The first bar is formed of base 230 of second handle portion 200. The second bar is formed of second handle 210 pivotally connected to base 230. The third bar is formed by rod 330 which contacts the first end 161 of lever 160 and tang 212 of second handle 210. The fourth bar is formed by the sliding contact of the lever 160 with tang 112 of first handle 110.

Figure 3:
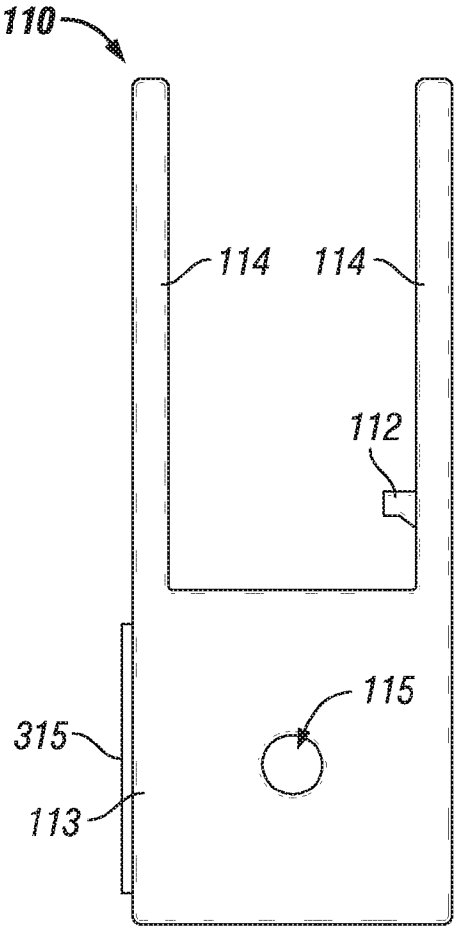

FIG. 3 shows a rear view of an embodiment of a first handle 110 for first handle portion 100. Contact plates 315 extend from the side of first handle 110. Tang 112 extends into the region between arms 114 of first handle 110. As shown, tang 112 may not be directly connected to body 113 and may extend laterally from an arm 114. When assembled, tang 112 extends into cavity 140 (shown in FIG. 2) in base 130 of first handle portion 100. Although tang 112 is shown extending from the arm 114 further from contact plates 315, it may extend from the arm 114 closest to contact plates 315 in other embodiments. Spring cavity 115 in body 113 is shaped to receive spring 116 (shown in FIG. 2).

FIG. 4 shows a rear view of an embodiment of a second handle 210 for second handle 200. Tang 212 extends into the region between arms 214 of second handle 210. As shown, tang 212 directly contacts body 213 and extends upward from body 213. When assembled, tang 212 extends into cavity 240 (shown in FIG. 2) in base 230 of second handle portion 200 and second handle 210 may pivot about pivot apertures 211. Spring cavity 215 in body 213 is shaped to receive spring 216 (shown in FIG. 2). A person of ordinary skill in the art having the benefit of this disclosure would appreciate that first handle 110 and second handle 210 may be interchangeable. For example, the upward extending tang 212 of second handle 210 may be incorporated into first handle portion 100. Similarly, the laterally extending tang 112 of first handle 110 and cavity 140 with opening 137 in the side of base 130 may be incorporated into second handle portion 200.

Figure 6:
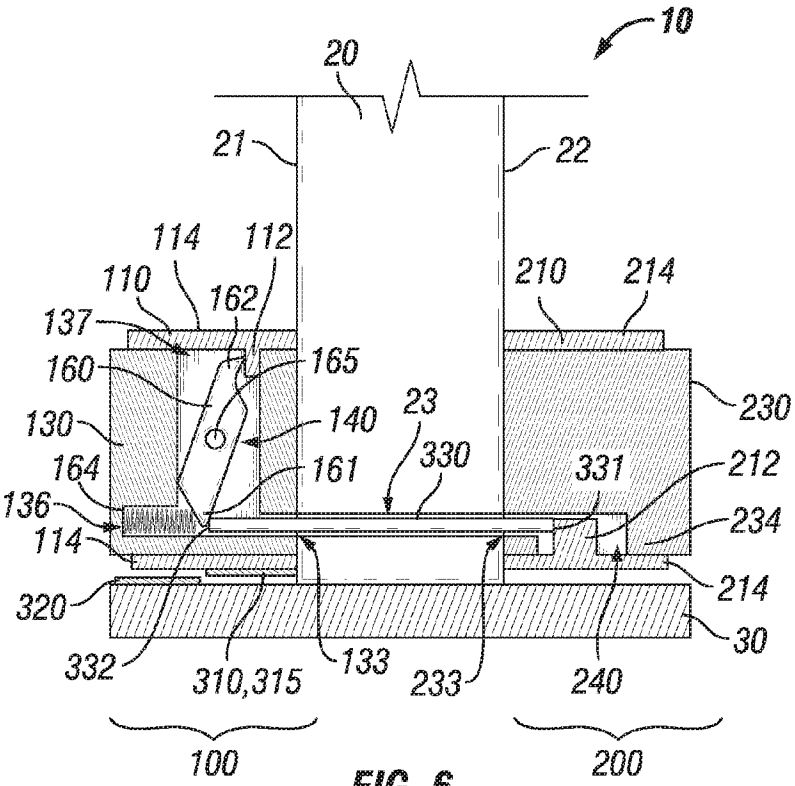
FIGS. 5 and 6 show cross-sectional views of the handle assembly of FIG. 1.
Figure 5:
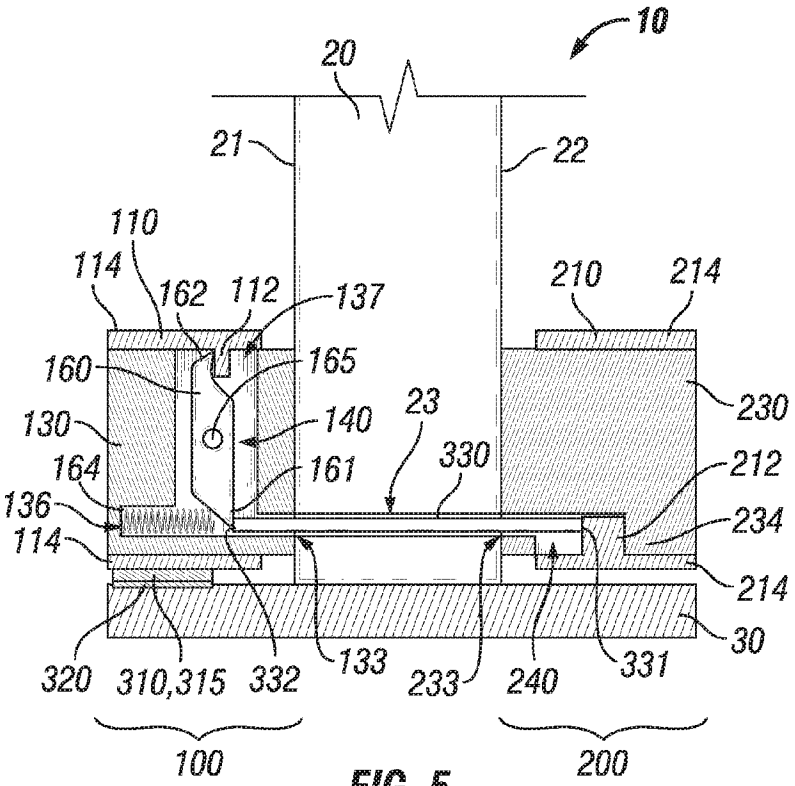

FIGS. 5 and 6 show cross-sectional views of handle assembly 10. FIG. 5 shows first handle portion 100 and second handle portion 200 in their engaged positions. FIG. 6 shows first handle portion 100 and second handle portion 200 in their disengaged positions. In the disengaged position, frame 20 is not inhibited by magnet 310 (shown in FIG. 1) from moving away from doorjamb 30. As shown in FIG. 5, base 130 of first handle portion 100 is connected to first side 21 of frame 20. Arms 114 of first handle 110 are positioned on each side of and are pivotally attached to base 130. Base 230 of second handle portion 200 is connected to second side 22 of frame 20. Arms 214 of second handle 210 are positioned on each side of and are pivotally attached to base 230.

Magnet 310 and contact plates 315 are positioned on an arm 114 of first handle 110. Tang 212 of second handle portion 200 extends into cavity 240 in base 230 and is engaged with lip 234 of base 230. The interface between tang 212 and lip 234 may prevent over-rotation of second handle 210. Lever 160 is pivotally positioned within cavity 140 of base 130. As shown, pin 165 creates an axis of rotation for lever 160. Tang 112 of first handle portion 100 extends through opening 137 in body 130 and into cavity 140. Tang 112 is engaged with the second end 162 of lever 160. The interface between tang 112 and the second end 162 of lever 160 may prevent over-rotation of first handle 110. Rod 330 extends through rod passage 133 in body 130 of first handle portion 100, rod passage 233 in body 130 of second handle portion 200, and through passage 23 in frame 20. Rod passages 133, 233 and passage 23 interconnect cavity 140 and cavity 240. Spring 164 is positioned within slot 136 in base 130 and biases the first end 161 of lever 160 into contact with second end 332 of rod 330. First end 331 of rod 330 may also be biased into contact with tang 212 of second handle portion 200. Contact plates 315 are aligned with striker plate 320 positioned on doorjamb 30. In this position, frame 20 is magnetically coupled to doorjamb 30 through the interaction between magnet 310 and striker plate 320 on doorjamb 30.

In order to decouple frame 20 from doorjamb 30, a user may operate either first handle portion 100 or second handle portion 200. A user may operate first handle portion 100 by pivoting first handle 110 of first handle portion 100 with respect to base 130. Pivoting may be accomplished by providing sufficient force to first handle 110 to overcome the spring force of spring 116 (shown in FIG. 2). As first handle 110 pivots, magnet 310 and contact plates 315 are pivoted away from striker plate 320 on doorjamb 30, thereby breaking the magnetic connection. However, the spring force of spring 164 may prevent lever 160 and second handle 210 of second handle portion 200 from moving as first handle 110 is pivoted. Once the magnetic connection has been broken, frame 20 may be moved away from doorjamb 30. For example, frame 20 may slide in a direction normal to doorjamb 30. Unlike known fixed handles, rotation of first handle portion 100 or second handle portion 200 reduces the force needed to open the screen door, is easier to operate, is intuitive, and does not deform the frame 20.

As shown in FIG. 6, a user may operate second handle portion 200 by pivoting second handle 210 of second handle portion 200 with respect to base 230. Pivoting may be accomplished by providing sufficient force to second handle 210 to overcome the spring force of spring 216 (shown in FIG. 2) and spring 164. As second handle 210 moves, tang 212 of plate 220 moves within cavity 240 and contacts first end 331 of rod 330 to move first end 331 of rod 330 toward first handle portion 100. Rod 330 slides within rod passages 133, 233 and passage 23. As rod 330 moves, second end 332 of rod 330 contacts the first end 161 of lever 160. Contact between second end 332 of rod 330 and first end 161 of lever 160 causes lever 160 to pivot clockwise about pin 165. Rotation of lever 160 depresses spring 164 within slot 136. The second end 162 of lever 160 engages tang 112 of first handle 110. Contact of tang 112 with second end 162 of lever 160 moves tang 112 towards frame 20, thereby causing first handle 110 to pivot about pivot pin 150 (shown in FIG. 1). As first handle 110 pivots, magnet 310 and contact plates 315 on arm 114 are pivoted away from striker plate 320 on doorjamb 30, thereby breaking the magnetic connection. Once the magnetic connection has been broken, frame 20 may be moved away from doorjamb 30.

In some embodiments, striker plate 320 may include at least one magnetic rail. In some embodiments, striker plate 320 includes two magnetic rails separated by a non-magnetic center. The distance between the two magnetic rails may be the same distance as the thickness of magnet 310. The non-magnetic center may allow uncoupling sooner than a magnetic center. For example, lateral motion of 0.05 inches may be needed rather than lateral motion of 0.36 inches. Accordingly, the range of movement needed to uncouple magnet 310 from striker plate 320 may be reduced. For example, movement may be reduced from rotation of 30 degrees to 17 degrees. Due to the configuration of frame 20 and doorjamb 30, a small angle of rotation may be desirable.

Figure 7:
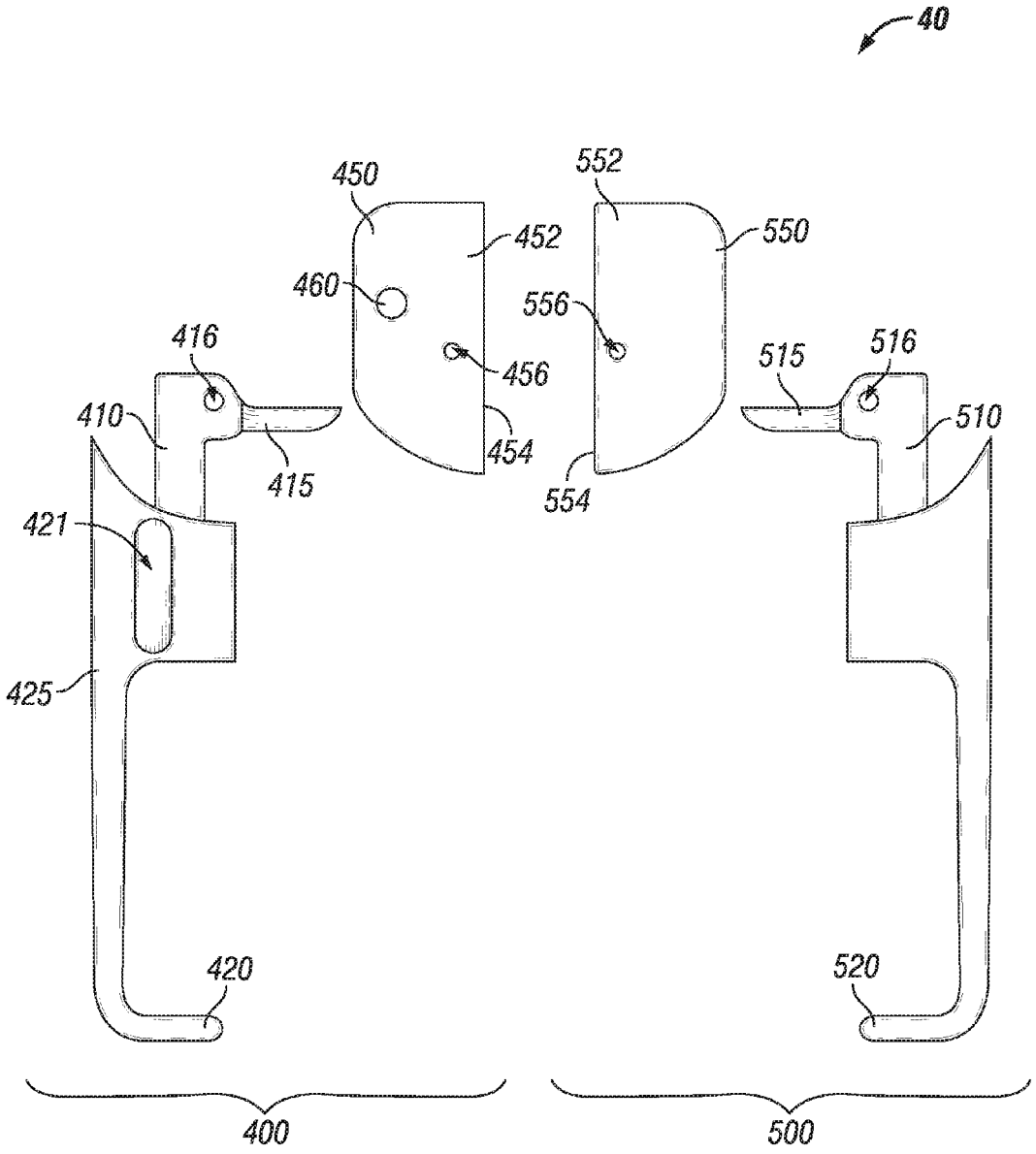
FIG. 7 shows an exploded view of an embodiment of a handle assembly.

FIG. 7 shows an exploded view of an embodiment of a handle assembly 40 having a first handle 400 and a second handle 500. First handle 400 includes a protrusion 410, grip 420, and base 450. Base 450 is configured to be mounted to a frame. The frame may be a sliding frame, such as a retractable sliding screen door or window. Protrusion 410 and grip 420 may be a single integral piece. Protrusion 410 includes a tang 415 extending laterally and to be positioned within the frame when assembled. Protrusion 410 includes a pin aperture 416. Base 450 includes an open bottom 454 and a pin aperture 456. Base 450 may include a body 452 that covers protrusion 410 and at least a portion of tang 415. Pin aperture 456 is configured to align with pin aperture 416 of protrusion 410 and receive a pin (not shown) to allow pivotal motion of grip 420 with respect to base 450. Tang 415 may extend through open bottom 454 and into a portion of the frame. First handle 400 and accompanying base 450 may be installed along a vertical axis of the frame. First handle 400 includes a recess 421 in a side 425 of grip 420 that is configured to receive a magnet 310 and contact plates 315 as described above with respect to FIG. 1.

Second handle 500 includes a protrusion 510, grip 520, and base 550. Base 550 is configured to be mounted to a frame. Protrusion 510 includes a tang 515 extending laterally and to be positioned within the frame. Protrusion 510 and grip 520 may be a single integral piece. Protrusion 510 includes a pin aperture 516. Base 550 may include an open bottom 554 and a pin aperture 556. Base 550 may include a body 552 that covers protrusion 510 and at least a portion of tang 515. Pin aperture 556 is configured to align with pin aperture 516 of protrusion 510 and receive a pin (not shown) to allow pivotal motion of grip 520 with respect to base 550. Tang 515 may extend through open bottom 554 and into a portion of the frame. Second handle 500 and accompanying base 550 may be installed along a vertical axis of the frame.

In some embodiments, manufacture of first handle 400 and second handle 500 may use some identical components. Tang 415 of first handle 400 and tang 515 of second handle 500 may have complimentary shapes. Tang 415 of first handle 400 may engage the corresponding tang 515 on second handle 500. Tang 415 is positioned adjacent to tang 515 when handle 40 is assembled. Tang 415 may be positioned under tang 515. Movement of grip 520 causes tang 515 of second handle 500 to contact tang 415 of first handle 400 such that movement of grip 520 also moves grip 420 of first handle 400. First handle 400 and second handle 500 are each movable between an engaged position and a disengaged position. In the engaged position, magnet 310 on first handle 400 magnetically couples handle assembly 40 to doorjamb 30. In the disengaged position, magnet 310 does not magnetically couple handle assembly 40 to doorjamb 30.

Movement of either grip 420 or grip 520 can be used to operate handle assembly 40. As shown, a lifting motion of either grip 420 or grip 520 transitions first handle 400 and second handle 500 between its engaged position and its disengaged position. A lifting force applied to grip 420 pivots grip 420 with respect to base 450. Movement of grip 420 slides magnet 310 laterally along striker plate 320, thereby releasing the frame from striker plate 320.

A lifting force applied to grip 520 pivots grip 520 with respect to base 450. The pivoting motion causes tang 515 to pivot in a counter-clockwise direction and engage tang 415 of first handle 400. The engagement between tang 415 and tang 515 transfers the force applied to grip 520 of second handle 500 into grip 420 of first handle 400. The transferred force pivots grip 420 of first handle 400 in a clockwise direction and uncouples magnet 310 from striker plate 320.

Handle assembly 40 may include a pawl 460. Pawl 460 may prohibit or inhibit grip 520 and grip 420 from being moved unless the frame is completely closed. By way of example, pawl 460 may be positioned between first handle 400 and base 450 to restrict relative motion. A pin (not shown) may be configured to release pawl 460 and allow relative motion when the frame is completely closed. Pawl 460 may be engaged and released when base 450 is positioned against doorjamb 30. A spring (not shown) may bias pawl 460 in an extended position.

In some embodiments, the magnet may be moved rotationally, vertically, horizontal, laterally, or diagonally to decouple the magnetic connection between the frame and the doorjamb. In some embodiments, the position of the magnet and striker plate may be reversed.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A handle assembly comprising:

a first handle moveably attached to a first base;

a second handle moveably attached to a second base; and a magnet having a magnetic face oriented away from the first handle, the magnet being affixed to a side of the first handle such that the magnet is stationary relative to the first handle, wherein the magnetic face is configured to magnetically couple the first handle to a face of a striker plate;

wherein movement of the first handle with respect to the first base moves the magnet relative to the striker plate from a first position, in which the magnetic face of the magnet magnetically engages the face of the striker plate, to a second position, and movement of the second handle with respect to the second base causes the movement of the first handle with respect to the first base, the magnetic face of the magnet in the second position magnetically engaging with less of the face of the striker plate than in the first position.

2. The handle assembly of claim 1, wherein the first handle is pivotally attached to the first base.

3. The handle assembly of claim 1, wherein the movement of the magnet comprises rotation of the magnet relative to the striker plate.

4. The handle assembly of claim 3, wherein the rotation of the magnet is about an axis normal to the face of the striker plate.

5. A handle assembly comprising:

a first base having a rod passage;

a first handle moveably attached to the first base;

a lever rotatably connected to the first base;

a second base having a rod passage;

a second handle moveably attached to the second base;

a rod extending through the rod passage of the first base and the rod passage of the second base; and a magnet configured to magnetically couple the first handle to a striker plate, wherein movement of the first handle with respect to the first base moves the magnet, and movement of the second handle with respect to the second base causes movement of the rod such that the movement of the rod rotates the lever and the rotation of the lever causes the movement of the first handle with respect to the first base.

6. The handle assembly of claim 5, wherein the first handle includes a first tang positioned adjacent to an end of the lever.

7. The handle assembly of claim 5, wherein the lever is positioned within a cavity in the first base.

8. The handle assembly of claim 7, wherein the first base includes a floor below the cavity and the cavity includes a side opening.

9. The handle assembly of claim 5, wherein the second handle is pivotally attached to the second base.

10. A handle assembly for a retractable screen, the handle assembly comprising:

a first handle pivotable about a first axis, the first handle configured to be affixed to a frame of the retractable screen; and a group consisting of a magnet and a striker plate, one of the group configured to be affixed to the first handle and the other of the group configured to be affixed to a doorjamb, the magnet having a magnetic face oriented toward a face of the striker plate when assembled, the group being configured to magnetically couple the handle assembly to the doorjamb;

wherein pivotal movement of the first handle, when the retractable screen is in a closed position, is configured to change an angular position of the one of the magnet and the striker plate from a first angular position to a second angular position so as to uncouple the handle assembly from the doorjamb, the magnetic coupling of the magnet and striker plate in the first angular position being sufficient to hold the retractable screen in the closed position and the magnetic coupling of the magnet and striker plate in the second angular position allowing the retractable screen to automatically retract.

11. The handle assembly of claim 10, further comprising a second handle pivotable about a second axis, wherein pivotal movement of the second handle is configured to cause the pivotal movement of the first handle about the first axis.

12. The handle assembly of claim 11, wherein the first handle includes a first tang and the second handle includes a second tang.

13. The handle assembly of claim 12, wherein the first tang is positioned adjacent to the second tang, and the pivotal movement of the second handle causes the second tang to contact the first tang and cause the pivotal movement of the first handle.

14. The handle assembly of claim 12, further comprising:

a rod having a first end and a second end; and a lever having a first end and a second end, the lever being rotatable about a third axis;

the first tang being positioned adjacent to the second end of the lever, the second tang being positioned adjacent to the first end of the rod, and the second end of the rod being positioned adjacent to the first end of the lever.

15. The handle assembly of claim 10, wherein the first axis is normal to the face of the striker plate.

16. The handle assembly of claim 10, wherein the magnetic face of the magnet in the second angular position does not magnetically engage with the face of the striker plate.

17. A method to couple and uncouple a retractable screen from a doorjamb, the retractable screen having a first handle attached to a frame, the method comprising:

magnetically coupling a magnetic face of a magnet with a face of a striker plate, wherein one of the magnet and the striker plate is positioned on the doorjamb, the magnet and the striker plate forming a first angular orientation with respect to each other, the magnetic coupling of the magnetic face of the magnet and the face of the striker plate in the first angular orientation holds the retractable screen in a closed position; and moving the first handle with respect to the frame when the retractable screen is in the closed position, wherein the other of the magnet and the striker plate is carried with the first handle such that the other of the magnet and the striker plate moves to a second angular orientation when the first handle is moved with respect to the frame, the magnetic coupling of the magnetic face of the magnet and the face of the striker plate being lessened in the second angular orientation such that it allows the retractable screen to automatically retract.

18. The method of claim 17, wherein the movement of the other of the magnet and the striker plate to the second angular orientation comprises sliding the other of the magnet and the striker plate laterally across the one of the magnet and the striker plate positioned on the doorjamb to the second angular orientation so as to uncouple the magnet from the striker plate.

19. The method of claim 17, wherein the moving of the first handle comprises pivoting the first handle.

20. The method of claim 19, further comprising pivoting a second handle, wherein the pivoting of the second handle causes the pivoting of the first handle.

21. The method of claim 19, wherein the pivoting of the first handle does not cause a second handle to pivot.

22. The method of claim 17, wherein the moving of the first handle comprises:

moving a second handle so as to contact a first end of a rod with a portion of the second handle contacting a first end of a lever with a second end of the rod such that the lever is rotated; and contacting a portion of the first handle with a second end of the lever as the lever rotates.

23. The method of claim 17, further comprising automatically retracting the retractable screen by sliding the first handle and frame away from the doorjamb in a direction normal to the face of the striker plate after uncoupling the magnet from the striker plate.

24. The method of claim 17, wherein the magnet is carried with and stationary relative to the first handle.

25. The method of claim 24, wherein the movement to the second angular orientation comprises rotating the magnet to uncouple the magnet from the striker plate.

26. The method of claim 25, wherein the rotation of the magnet is about an axis normal to the striker plate.

* * * * *